United States Patent [19]

Rutten et al.

[11] Patent Number: 4,899,717

[45] Date of Patent: Feb. 13, 1990

[54] AIRGUN

[75] Inventors: Léon Rutten, Liege; Jean Rutten, Chaudfontaine, both of Belgium

[73] Assignee: Centre D'Innovations Et De Recherches Appliquers, societe anonyme, Vise, Belgium

[21] Appl. No.: 127,375

[22] Filed: Dec. 2, 1987

[30] Foreign Application Priority Data

Dec. 12, 1986 [BE] Belgium ..... 61106

[51] Int. Cl.[4] ..... F41B 11/00

[52] U.S. Cl. ..... 124/67; 124/66; 124/32

[58] Field of Search ..... 124/3, 32, 56, 60, 64–67, 124/77, 80, 41 C

[56] References Cited

U.S. PATENT DOCUMENTS

| | | | |
|---|---|---|---|
| 1,167,178 | 1/1916 | Hill | 124/56 |
| 1,343,127 | 6/1920 | Hallinan | 124/32 |
| 1,447,458 | 3/1923 | Zint | 124/67 |
| 2,568,432 | 9/1951 | Cook | 124/65 |
| 2,834,332 | 5/1958 | Guthrie | 124/77 |
| 3,128,753 | 4/1964 | Politzer | 124/26 |
| 3,192,915 | 7/1965 | Norris et al. | 124/32 |
| 3,212,490 | 10/1965 | Merz | 124/56 |
| 3,523,538 | 8/1970 | Shimizu | 124/67 |
| 4,579,100 | 4/1986 | Whitaker | 124/32 |
| 4,694,815 | 9/1987 | Hung | 124/32 |

*Primary Examiner*—Randolph A. Reese
*Assistant Examiner*—Anthony Knight
*Attorney, Agent, or Firm*—Bacon & Thomas

[57] ABSTRACT

An airgun in which a spring-operated piston is provided for compressing air in a chamber, wherein arming of the gun is accomplished by a transport mechanism which acts on the piston to compress the spring, with the transport mechanism being driven by a battery-powered electric motor, the transport mechanism, electric motor and battery being incorporated within the airgun.

21 Claims, 3 Drawing Sheets

AIRGUN

BACKGROUND OF THE INVENTION

The invention concerns an electrically-armed compressed air gun, more particularly an airgun of the type in which air is compressed by means of a pump or spring.

The airgun may a carbine, revolver or other type of gun, used for competition shooting, as a toy, etc.

It is known that the major disadvantage of spring and pump-action airguns is that they must be armed manually, which is difficult even for an adult.

SUMMARY OF THE INVENTION

The aim of the invention is to avoid this and other disadvantages associated with airguns, and provide a weapon which can be armed without having to "break" the gun.

In order to achieve this, the invention consists of an airgun, of the type in which the air is compressed in the chamber by means of a spring-loaded piston, with the characteristic that compression of said spring is obtained by a battery-powered electric motor driving a transport mechanism which acts on the piston, for example through a catch, the complete mechanism being incorporated in the weapon.

BRIEF DESCRIPTION OF THE DRAWINGS

In order to explain the characteristics and advantages of the invention, the following examples of embodiments are described below with reference to the figures annexed, in which.

DETAILED DESCRIPTION OF THE PREFERRED EMBODIMENTS

Figure 1:
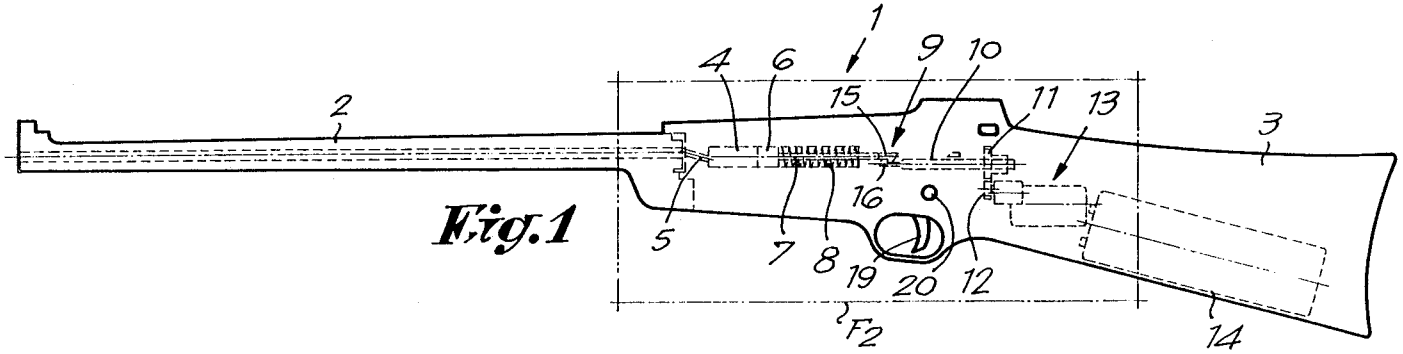
FIG. 1 is a schematic representation of an air rifle according to a first embodiment of the invention.
Figure 2:
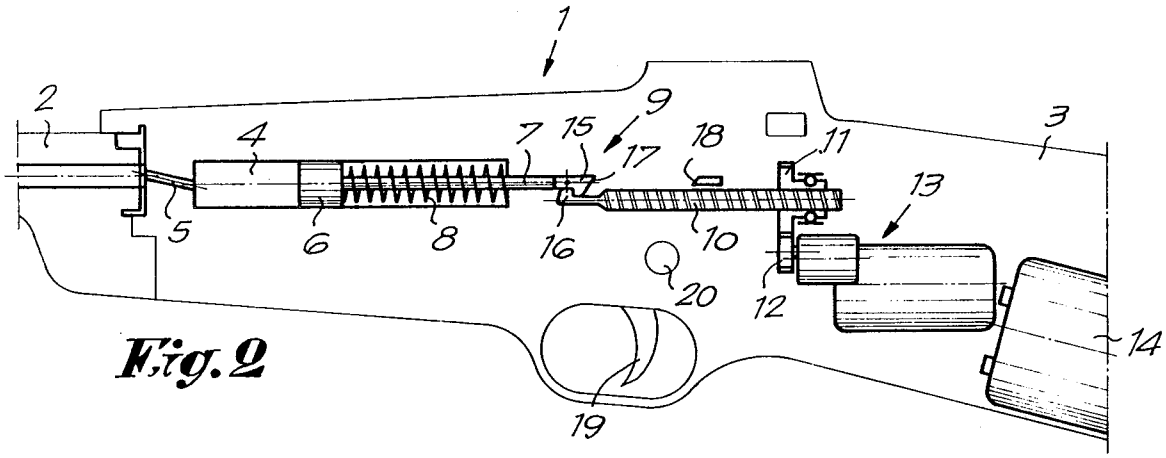
FIG. 2 is an enlarged view of the part in FIG. 1 indicated by F2, drawn to a bigger scale.

FIG. 1 represents an air rifle 1 consisting in the traditional manner of two main parts, namely the barrel 2 and the butt 3 containing the arming mechanism, the trigger mechanism, etc.

This schematic representation also shows: the air compression chamber 4 with an air outlet 5; the air compression piston 6 whose stem 7 is surrounded by a helical spring 8 which is captive between said piston 6 and the butt 3; a hook-and-catch mechanism 9 between the piston stem 7 and a worm 10; and a toothed nut 11 meshing with a gear driven by a stepped-down electric motor 13 connected to an electric cell or battery of cells 14.

The device 9 is represented schematically by a pivot-mounted, puller catch 15 which can engage the hooked end 16 of said worm 10. To enable it to release, the puller catch 15 has an inclined plane 17 which is pushed up by a sear 18, which is suitably connected to the trigger 19. The reversing stepped-down motor 13 can be controlled by an arming button 20.

The operation of the air rifle according to the invention is as follows.

Actuation of the pushbutton 20 causes said step-down motor 13 to be supplied with current, thus driving the gear 12 and the nut 11. This drives the worm 10 towards the rear (towards the right in the diagram) so that the puller catch 15 is drawn by the hooked end 16, thus compressing the spring 8. The displacement of said piston 6 is halted when the inclined plane of the puller catch 15 is situated just behind the sear 18. The stepped-down motor can for example be stopped by means of a limit switch (not shown in the figures).

To fire the gun, the trigger is pulled, thus causing the sear 18 to move or pivot and release the puller catch 15, and also release the piston 6. Said piston 6 is propelled forwardly by the spring 8, thus compressing the air contained in the chamber 4 and firing the projectile in the barrel 2.

While the piston 6 moves forward, the piston stem 7 actuates a switch (not shown in the figures) which operates the stepped-down motor 13 in the reverse direction, so that the puller catch 15 once more engages the hooked end 16 of the worm 10, ready for arming once more.

FIGS. 3 to 6 show a variant embodiment which includes the above-mentioned components 1 to 8 and 10 to 13, as well as the sear 18, the trigger 19 and the arming button 20. In this embodiment the piston 6 comprises an extension 21 in the form of a tube 22. Said tube 22 has three oblong holes, 23, 24 and 25, which serve to guide the piston 6 in a breach casing 26 by means of a guide 27, thus preventing the piston 6 from turning around its axis when it engages a pusher catch 28 and a sear 18.

The piston 6 has a guide stem 29 which slides in a tube 30 mounted in the breach casing 26.

The spring 8 surrounds the guide stem 29 and the tube 30.

The sear 18 is connected in a suitable manner to the trigger 19. The stepped-down motor 13 is mounted underneath the compressed air chamber 4. The output shaft 31 of the motor 13 is connected to the worm 10 on which is mounted the nut 11. Note that in this case it is the worm 10 which rotates and the nut 11 which moves axially. On the nut 11 is mounted the pusher catch 28 which can swivel between two stops 33 and 34. The pusher catch 28, which swivels on a pivot 32, is held by a keeper spring 35 attached to the nut 11.

The nut 11 trips two limit switches 36 and 37, one at either end of its travel.

Finally, the pusher catch 28 presses in a pin 38 against a spring 39.

Figure 3:
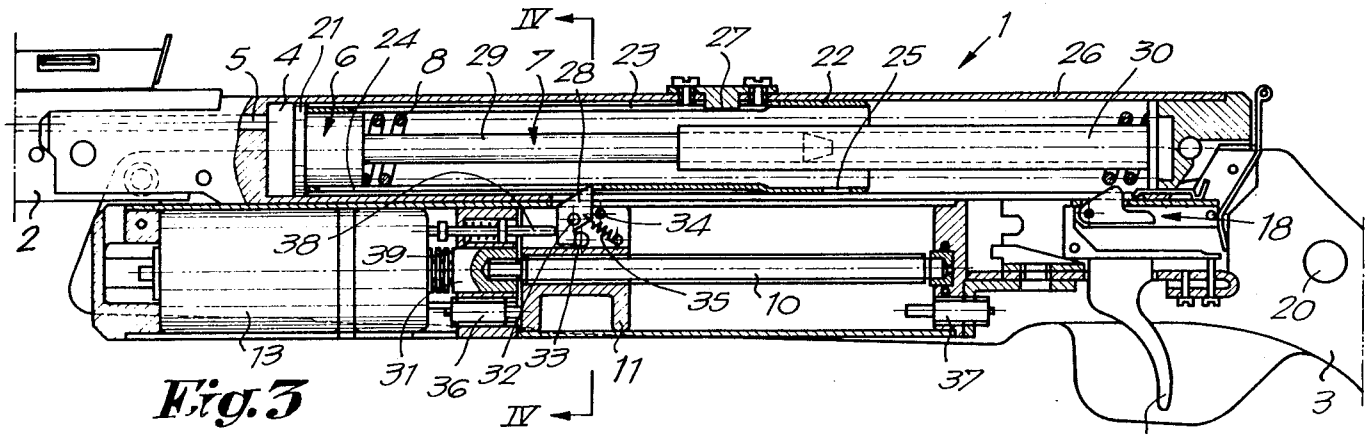
FIG. 3 is analogous to FIG. 3, but shows a second embodiment of the invention.
Figure 4:
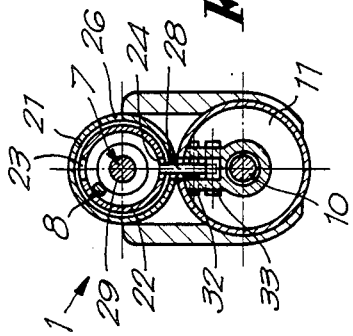
FIG. 4 shows a section along the line IV—IV in FIG. 3.
Figure 5:
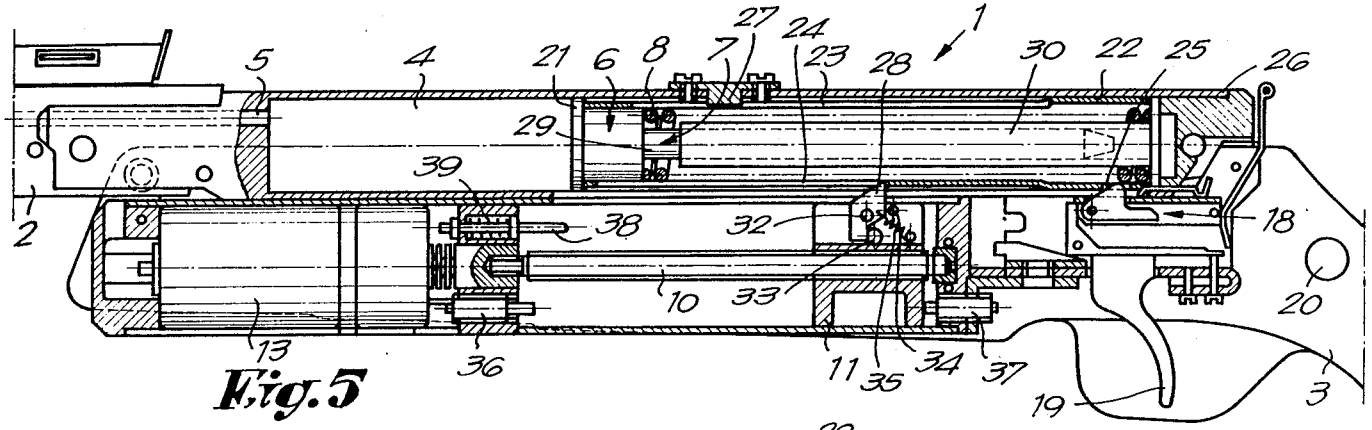
FIGS. 5 and 6 show views analogous to that of FIG. 3, but in two different positions.
Figure 6:
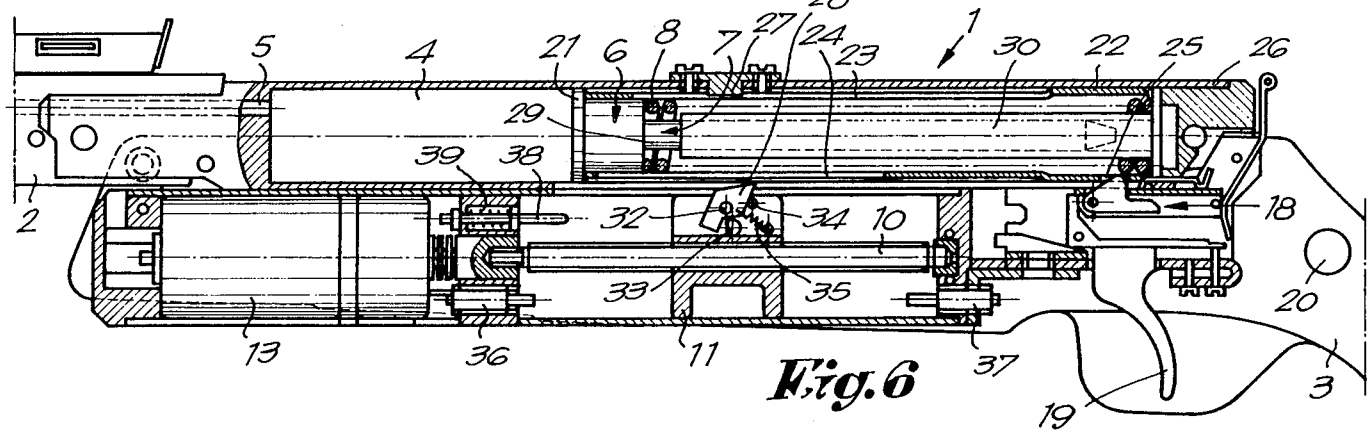

In the unarmed position, the rifle mechanism is in the position shown in FIG. 3. The piston 6 is in its farthest forward position, the spring 8 is relaxed, the pusher catch 28 is located in the groove 24 of the tube 22 and is held against the stop 33 by the pin 38.

To arm the weapon, the pushbutton 20 is first pressed, thus supplying the motor 13 with power from the battery mounted in the butt and causing the worm 10 to rotate.

This rotation of the worm 10 displaces the nut to the rear, thus releasing the limit switch 36. The pin 38 maintains the pusher catch 28 in a vertical position as long as the couple exerted by the spring 39 on the pin 38 is greater than the couple exerted on the pusher catch 28 by the keeper spring 35.

At a certain moment, the pusher catch 28 comes in contact with the piston 6, in particular with the tube 22 of the piston 6, thus making the pin 38 redundant. The nut therefore drives the piston 6 through the agency of the pusher catch, pushing the piston to the rear and compressing the arming spring 8.

When the nut 11 reaches its rearward end of travel, the piston engages the sear 18 through the hole 25, at which point the spring 8 is compressed to its maximum.

At this point also, the switch 37 is pushed in, thus causing the motor 13 to rotate in the reverse direction and so also the worm 11. The piston 6 remains held by the sear 18 until the trigger 19 is pulled.

When the nut travels back the other was the switch 37 is released. Its action of reversing the direction of rotation of the motor is memorized.

While travelling forward once more, the pusher catch 28 pivots down against the stop 34 under the action of the keeper spring 35, thus allowing the piston 6 to return when the gun is fired. At this moment there are two possibilities: the trigger may or may not be pulled during the return travel of the nut 11.

In the first case, if the trigger 19 is not pulled during the return travel of the nut 11, the pusher catch 28 remains lowered unit it comes in contact with the pin 38, which raises it again. At the end of its travel the nut 11 engages the limit switch 36 and thus stops. When the trigger 19 is pulled, the sear 18 moves down and the piston 6 is propelled forward under the action of the spring 8 so that the air is suddenly compressed and the shot is fired, if the gun is loaded and not "broken". If the gun is broken, the air is wasted.

In the second case, if the trigger is pulled during the return travel of the nut 11, the sear moves down and releases the piston 6 while the pusher catch continues its rearward travel in the lowered position. The piston is propelled forwardly under the action of the spring 8 and the shot is fired while the nut 11 continues its return movement.

The pusher catch 28 comes up against the pin 38 which tries to raise it again, but this is not possible since the pusher catch comes up against the external wall of the piston 6 and 22, which does not present any opening or groove at this point. The pusher catch does not rise up again until it meets the opening 24.

The return travel is halted when the limit switch 36 is tripped by the nut 11.

It is clear that various modifications made to be made to the mechanism as described above, while still remaining within the scope of the invention.

We claim:

1. An airgun of the type wherein a projectile is fired by compressed air from a chamber provided with a spring-operated piston, the improvement comprising a breech casing, a transport mechanism for compressing the piston spring, the transport mechanism including a worm, a nut mounted on the worm for longitudinal movement therealong with respect to the breech casing between forward and rearward positions, and a pusher catch mounted on the nut, an electric motor for driving the transport mechanism, a battery for powering the electric motor, and the transport mechanism, electric motor and battery being incorporated within the airgun.

2. The airgun of claim 1 wherein the piston includes an extension section for compressing air within the chamber and a tube-shaped section, and the spring being housed within the tube-shaped section.

3. The airgun of claim 1 further including a guide tube mounted on the breech casing, the extension section of the piston being provided with a stem, and the stem passing through the spring and being slidably disposed within the guide tube.

4. The airgun of claim 3 further including guidance means for guiding the piston in a longitudinal direction.

5. The airgun of claim 4 wherein the guidance means is disposed between the stem and the guide tube.

6. The airgun of claim 4 wherein the guidance means is disposed between the piston and the breech casing.

7. An airgun of the type wherein a projectile is fired by compressed air from a chamber provided with a spring-operated piston, the improvement comprising the piston including an extension section for compressing the air in the chamber and a tube-shaped section, the spring being housed within the tube-shaped section, the tube-shaped section being provided with two oblong holes, a pusher catch being engageable within one oblong hole, a sear, the sear being engageable within the other oblong hole when the piston reaches an arming position, a transport mechanism for compressing the piston spring, an electric motor for driving the transport mechanism, a battery for powering the electric motor, and the transport mechanism, electric motor and battery being incorporated within the airgun.

8. The airgun of claim 7 further including a breech casing, a worm, a nut mounted on the worm for longitudinal movement therealong with respect to the breech casing between forward and rearward positions, and the pusher catch being mounted on the nut.

9. The airgun of claim 8 further including a limit switch disposed at each end of the worm, the limit switches being engageable by the nut in the forward and rearward positions for changing the direction of rotation of the motor.

10. The airgun of claim 8 wherein the piston is mounted above the worm.

11. The airgun of claim 7 further including a nut, a pair of stops, and the pusher catch being mounted on the nut for pivotal movement between the pair of stops.

12. The airgun of claim 11 further including a keeper spring mounted between the pusher catch and the nut for urging the pusher catch against one of the stops.

13. The airgun of claim 12 wherein the pusher catch pivots between an upper position in which it engages the oblong hole and a lower position in which it is disengaged from the oblong hole.

14. The airgun of claim 13 further including a pin, the pin being engageable against the pusher catch for maintaining the pusher catch in the upper position when the nut is in the forward position.

15. The airgun of claim 14 further including a spring for urging the pin into engagement against the pusher catch.

16. An airgun of the type wherein a projectile is fired by compressed air from a chamber provided with a spring-operated piston, the improvement comprising a breech casing, a guide tube mounted on the breech casing, the extension section of the piston being provided with a stem, the stem passing through the spring and being slidably disposed within the guide tube, guidance means for guiding the piston in a longitudinal direction, the guidance means being disposed between the stem and the guide tube and including a groove in a tube-shaped section of the piston and a guide slidably disposed within the groove, a transport mechanism for compressing the piston spring, an electric motor for driving the transport mechanism, a battery for powering the electric motor, and the transport mechanism, electric motor and battery being incorporated within the airgun.

17. An airgun of the type wherein a projectile is fired by compressed air from a chamber provided with a spring-operated piston, the improvement comprising the piston including a stem having an end, a transport mechanism including a worm driven by a nut, the end of the stem being detachably engageable to the worm, a reversible electric motor for driving the transport mechanism, the nut being rotatable by the reversible electric motor in a stationary position about an axis of rotation, a battery for powering the electric motor, and the transport mechanism, electric motor and battery being incorporated within the airgun.

18. The air gun of claim 17 wherein the reversible electric motor includes a drive shaft, a gear wheel mounted on the drive shaft, and the nut being provided with gear teeth disposed in meshed engagement with the gear wheel.

19. The air gun of claim 17 wherein the piston and the worm are mounted one behind the other.

20. The air gun of claim 17 wherein the end of the stem includes a pivotal catch, the worm includes a hooked end, and the pivotal catch being detachably engageable with the hooked end.

21. The air gun of claim 20 further including a trigger, a sear connected to the trigger for engaging the pivotal catch when the trigger is pulled to detach the pivotal catch from the hooked end.

* * * * *